US010773373B2

(12) United States Patent
Vela

(10) Patent No.: US 10,773,373 B2
(45) Date of Patent: Sep. 15, 2020

(54) TOOL WORK BAG APPARATUS AND METHOD

(71) Applicant: Michael Anthony Vela, Pasadena, TX (US)

(72) Inventor: Michael Anthony Vela, Pasadena, TX (US)

( * ) Notice: Subject to any disclaimer, the term of this patent is extended or adjusted under 35 U.S.C. 154(b) by 38 days.

(21) Appl. No.: 16/179,898

(22) Filed: Nov. 3, 2018

(65) Prior Publication Data

US 2020/0139534 A1 May 7, 2020

(51) Int. Cl.

| | |
|---|---|
| ***B25H 3/00*** | (2006.01) |
| ***E06C 7/14*** | (2006.01) |
| ***B66F 13/00*** | (2006.01) |

(52) U.S. Cl.

CPC ..... *B25H 3/00* (2013.01); *B66F 13/00* (2013.01); *E06C 7/14* (2013.01)

(58) Field of Classification Search

CPC ... B25H 3/00; E06C 7/14; E06C 7/146; B66F 13/00

USPC ..... 206/349, 372, 373

See application file for complete search history.

(56) References Cited

U.S. PATENT DOCUMENTS

| | | | | |
|---|---|---|---|---|
| 6,766,881 | B2 * | 7/2004 | Carty | E06C 7/14 182/129 |
| 8,177,029 | B1 * | 5/2012 | Norton | B25H 3/02 182/129 |
| 8,844,717 | B1 * | 9/2014 | Ross | B25H 3/00 182/129 |
| 2005/0189388 | A1 * | 9/2005 | Godshaw | A45C 3/00 224/607 |
| 2005/0224392 | A1 * | 10/2005 | Perry | B65D 85/20 206/750 |
| 2006/0144732 | A1 * | 7/2006 | Kaplan | B25H 3/00 206/349 |
| 2009/0277937 | A1 * | 11/2009 | Sabbag | B25H 3/00 224/236 |
| 2016/0375574 | A1 * | 12/2016 | Reinhart | B25H 1/12 269/16 |
| 2017/0188674 | A1 * | 7/2017 | Dotey | A45C 7/0095 |

* cited by examiner

*Primary Examiner* — Rafael A Ortiz
(74) *Attorney, Agent, or Firm* — Darryl Edwin Scott

(57) ABSTRACT

A mountable fabric having a first fabric section having a first fabric end, and a second fabric section having a second fabric end opposite the first fabric end. The fabric having a fabric seam coupled between the first fabric section and the second fabric section. The fabric having a plurality of pockets coupled to the first fabric section. A first locking mechanism secured to the first fabric end, and a second locking mechanism secured to the second fabric end, wherein when the mountable fabric is folded along the fabric seam the first locking mechanism is couplable to the second locking mechanism.

7 Claims, 7 Drawing Sheets

TOOL WORK BAG APPARATUS AND METHOD

BACKGROUND

Construction and manufacturing workers require accessibility to specific tools for specific tasks. In many instances, tools are inaccessible because of limited mobility and spatial constraints within the work environment, such as, for example an aerial platform lift. Requiring the worker to constantly maneuver to access tools in a limited workspace can be difficult and counterproductive. Having ergonomically accessible tools in a limited work environment is a challenge.

DETAILED DESCRIPTION

The following detailed description illustrates embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques. Therefore, the description that follows is not to be taken as limiting on the scope of the appended claims. In particular, an element associated with a particular embodiment should not be limited to association with that particular embodiment, but should be assumed to be capable of association with any embodiment discussed herein.

An embodiment described herein generally relates to the method of having a tool work bag that is ergonomically designed to assist in the handling of tools, whether for professionals employed in industries like construction and manufacturing, or amateurs. Tool work bags that are attached to the body of a worker can, over time, cause the worker to fatigue (due to the weight of the bag), which can reduce the worker's productivity and decrease the worker's mobility. Further, the tool work bag that is attached to the body of the worker may not possess the capability to hold the tools necessary to complete the task (i.e., the tool is too large or too heavy to carry on the person or in the tool work bag).

An embodiment described herein also provides a method of accessing tools in limited work environments. For example, aerial platform lifts provide a limited amount of square footage within which a worker may operate. The constrained work environment of an aerial platform lift also limits the quantity of tools that are accessible to the worker. Having the tools laying on the floor of the aerial platform lift or hanging form the aerial platform lift can be dangerous to the worker and those below (e.g. when the aerial platform lift is extended).

Figure 1:
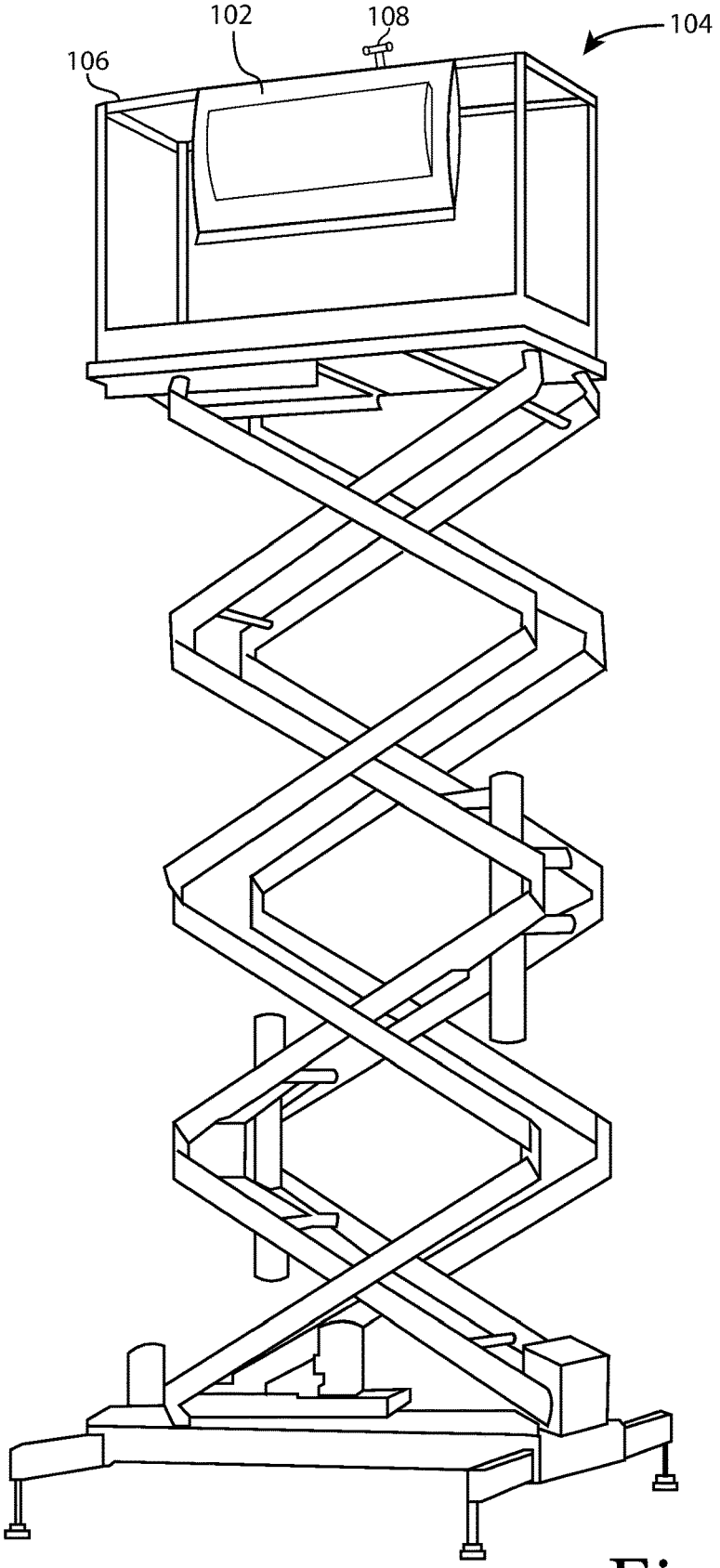
FIG. 1 is a perspective view of a mountable fabric coupled to an aerial platform lift.

FIG. 1 is a perspective view of a mountable fabric coupled to an aerial platform lift. In one or more embodiments, a fabric 102 is mounted on an aerial platform lift 104. The fabric 102 may be mounted on a rail 106. The fabric 102 may be mounted on a workhorse bench (not shown) or other similar railing. As illustrated in FIG. 1, the fabric 102 may straddle the rail 106, such that one end of the fabric 102 hangs on one side of the rail 106 and the other end of the fabric 102 hangs on the other side of the rail 106. The fabric 102 is mounted on the rail 106 such that the weight of the fabric 102 is evenly distributed to allow the fabric 102 to not fall off and instead balance upon the rail 106. In one or more embodiments, a tool 108 may be coupled to the fabric 102. In one or more embodiments, the tool 108 may be inserted into a pocket (described below in connection to FIG. 2) that is coupled to the fabric 102.

Figure 2:
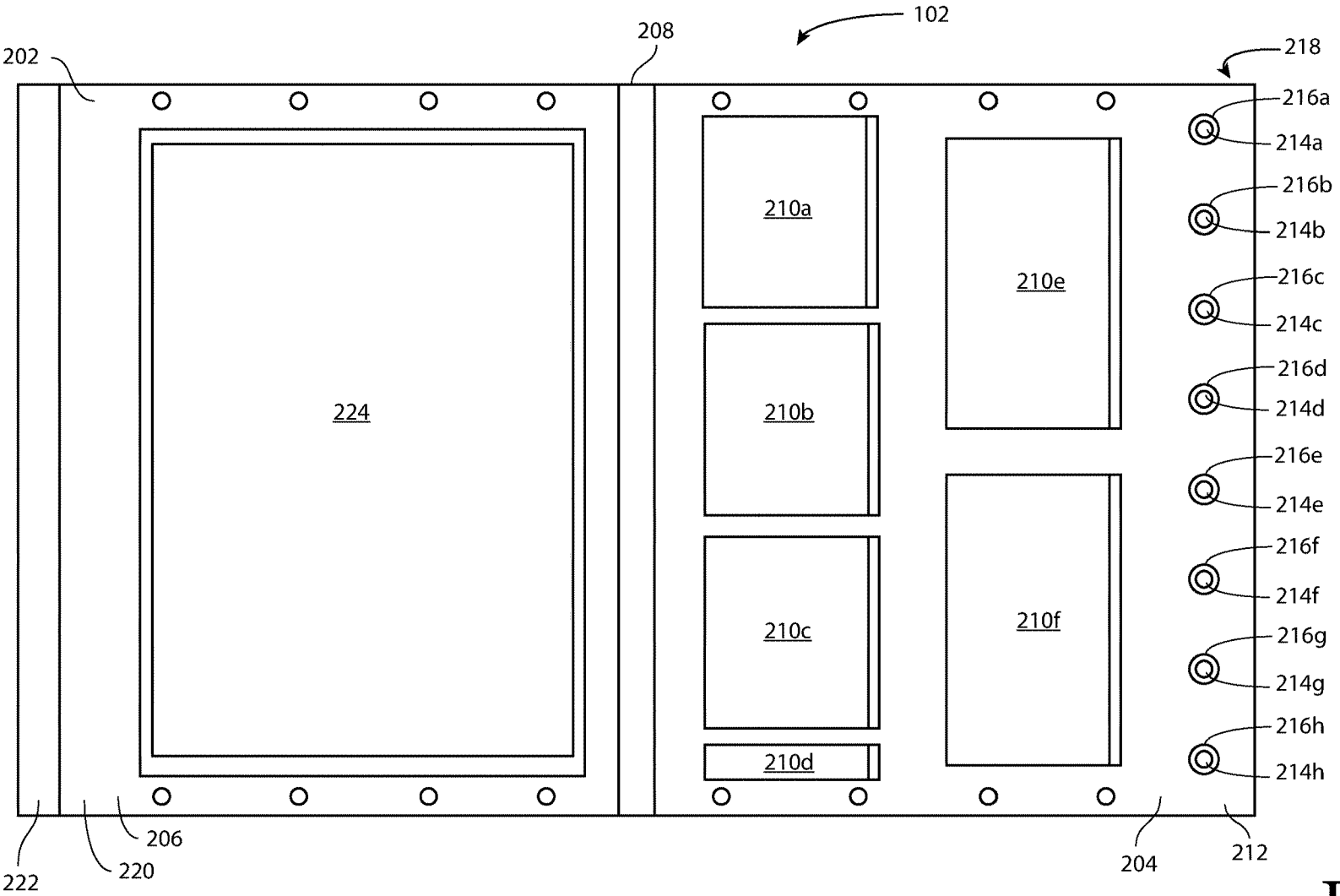
FIG. 2 is a plan view of a front side of a mountable fabric having a plurality of pockets and a detachable transparent pocket.

FIG. 2 is a plan view of a front side of a mountable fabric having a plurality of pockets and a detachable transparent pocket. The fabric 102 may be made of a durable material, such as Haartz® cloth provided by the Haartz Corporation, nylon fabric, leather, polymer, or other similar material durable enough to hold the tool 108 and other heavy items. In one or more embodiments, the fabric 102 has a front side 202. The front side 202 is the outer surface of the fabric 102 when the fabric 102 is mounted on the rail 106 (as illustrated in FIG. 1). The fabric 102 may include a first fabric section 204 and a second fabric section 206 opposite the first fabric section 204. As described above in connection to FIG. 1, the first fabric section 204 would hang on one side of the rail 106 and the second fabric section 206 would hang on the other side of the rail 106.

The first fabric section 204 and the second fabric section 206 are separated by a fabric seam 208. In one or more embodiments, the first fabric section 204 is coupled to the fabric seam 208. In one or more embodiments, the second fabric section 206 is coupled to the fabric seam 208. The first fabric section 204 may be sewn to the fabric seam 208 using nylon thread. The second fabric section 206 may be sewn to the fabric seam 208 using nylon thread. In one or more embodiments, the first fabric section 204, the second fabric section 206, and the fabric seam 208 may all be one uniform fabric (i.e. one continuous piece of fabric).

The fabric seam 208 may include a rigid material (not shown) that restricts the flexibility of the fabric seam 208. The rigid material may be detachable or sewn (e.g. using nylon thread) into the fabric seam 208. In one or more embodiments, the fabric seam 208 is the section of the fabric 102 that is mounted on the rail 106 such that the first fabric section 204 and the second fabric section 206 freely hangs from the rail 106. The rigid material may be made from durable material such as polymer and/or metal or other similar material.

In one or more embodiments, the first fabric section 204 includes one or more pockets 210 (illustrated in FIG. 2 as

210*a*, 210*b*, 210*c*, 210*d*, 210*e*, and 210*f*). The pockets 210 may be sewn into the fabric 102 using nylon fabric or other similar material. Although the first fabric section 204 shows a particular number of pockets 210, the first fabric section 204 may have a greater or lesser number of pockets 210 than illustrated. Further, each pocket 210 may vary in size, shape, and dimension or may all have one uniform dimension. For example, the pocket 210 may have a pocket width ranging from two inches (5.08 cm) to 12.5 inches (31.75 cm) and a pocket length ranging from four inches (10.16 cm) to 7.5 inches (19.05 cm). The pockets 210 may be made from the same material as the fabric 102. In one or more embodiments, the pockets 210 hold the tool 108 or other similar items. In one or more embodiments, the pockets 210 would be positioned on the interior side of the aerial platform lift 104 such that if the tools 108 were to fall from the pocket 210, the tools 108 would fall onto the floor of the aerial platform lift and onto those workers that may be below (i.e., when the aerial platform lift 104 is extended).

The first fabric section 204 may include a first fabric end 212. The first fabric end 212 may include a plurality of hollow notches 214 (illustrated in FIG. 2 as 214*a*, 214*b*, 214*c*, 214*d*, 214*e*, 214*f*, 214*g*, and 214*h*). The hollow notches 214 may be used to hang the tools 108. The hollow notches 214 may be reinforced by brass eyelets 216 (illustrated in FIG. 2 as 216*a*, 216*b*, 216*c*, 216*d*, 216*e*, 216*f*, 216*g*, 216*h*) or other similar material.

Figure 3:
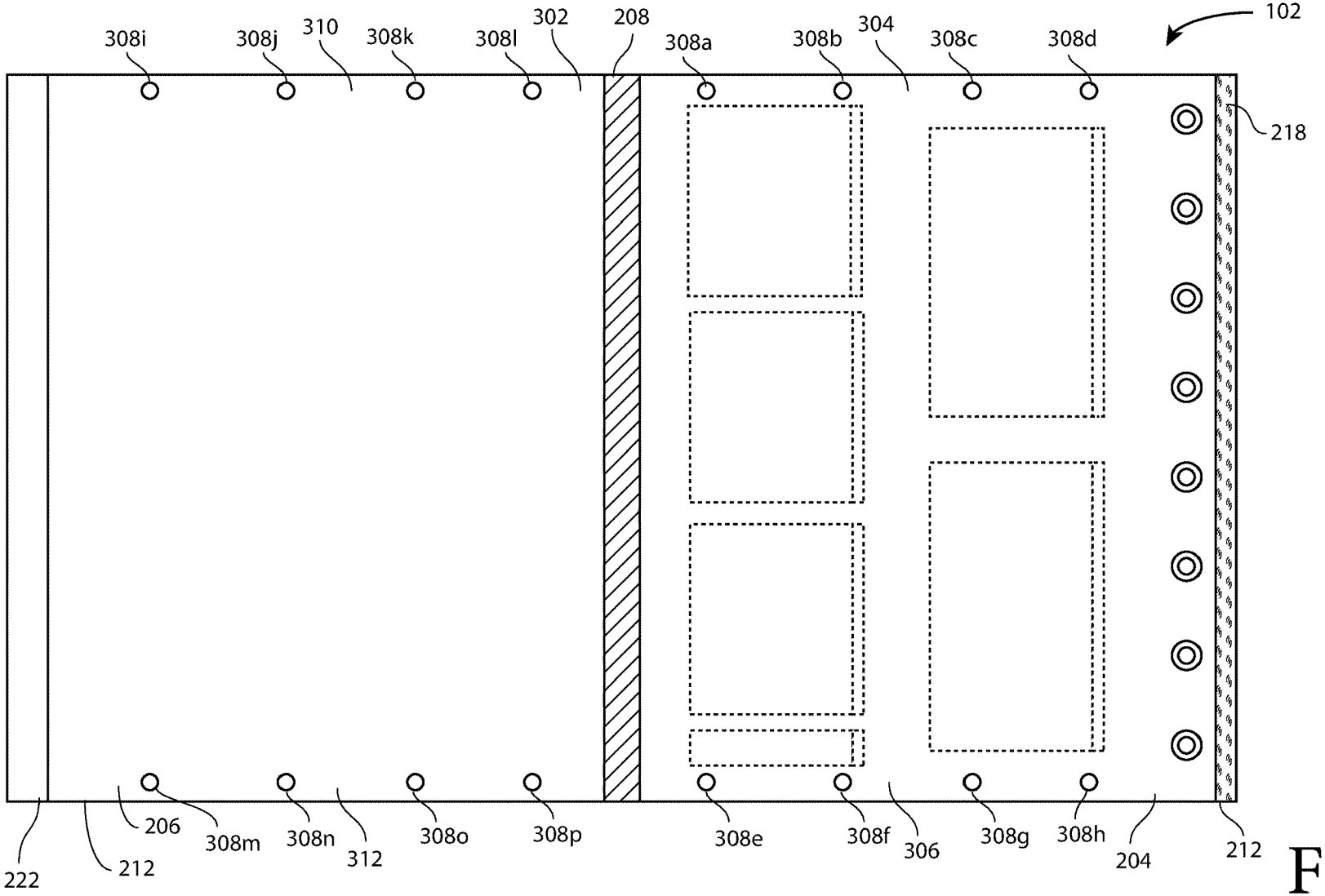
FIG. 3 is a plan view of a rear side of a mountable fabric having a plurality of pockets and a detachable transparent pocket.

The first fabric end 212 may include a first locking mechanism 218 (not visible in FIG. 2, but illustrated in FIG. 3). The first locking mechanism 218 may be made from such material as Velcro® provided by Velcro Industries B.V., or any similar material. The first locking mechanism 218 may be coupled to the fabric 102. The first locking mechanism may be sewn to the fabric 102 using nylon thread. The first locking mechanism 218 may include snap buttons (not shown).

In one or more embodiments, the second fabric section 206 includes a second fabric end 220 opposite the first fabric end 212. The second fabric end 220 may include second locking mechanism 222. The second locking mechanism 222 may be made from such material as Velcro ® provided by Velcro Industries B.V., or any similar material. The second locking mechanism may be coupled to the fabric 102. The second locking mechanism may be sewn to the fabric 102 using nylon thread. The second locking mechanism 222 may include snap buttons (not shown). The first locking mechanism 218 made from a metal alloy. The second locking mechanism 222 may include a magnet.

In one or more embodiments, the second fabric section 206 includes a detachable transparent pocket 224. The lining of the detachable transparent pocket 224 may be made from the same or similar material as the fabric 102. The transparent portion of the detachable transparent pocket 224 may be made from transparent or see-through material, such as for example, 30-gauge durable polish plastic, to allow the worker to visually see the contents housed in the detachable transparent pocket 224. For example, the detachable transparent pocket 224 may be used to hold blueprints, and thus it is more efficient to be able to access the blueprints visually while they remain in the detachable transparent pocket 224, instead of having to repeatedly remove the blue prints from the detachable transparent pocket 224.

FIG. 3 is a plan view of a rear side of a mountable fabric having a plurality of pockets and a detachable transparent pocket. In one or more embodiments, the fabric 102 has a rear side 302. The rear side 302 is the inner surface of the fabric 102 when the fabric 102 is mounted on the rail 106 (as illustrated in FIG. 1). In one or more embodiments, the first fabric section 204 includes a first fabric side 304. In one or more embodiments, the first fabric section 204 includes a second fabric side 306 opposite the first fabric side 304. The first fabric side 304 may include a first set of snap buttons 308 (illustrated in FIG. 3 as 308*a*, 308*b*, 308*c*, and 308*d*) positioned along the first fabric side 304. The second fabric side 306 may include a plurality of snap buttons 308 (illustrated as 308*e*, 308*f*, 308*g*, and 308*h*).

In one or more embodiments, the second fabric section 206 may include a third fabric side 310. The second fabric section 206 may include a fourth fabric side 312 opposite the third fabric side 310. The third fabric side 310 may include a third set of snap buttons 308 (illustrated in FIG. 3 as 308*i*, 308*j*, 308*k*, and 308*l*). The fourth fabric side 312 may include a fourth set of snap buttons 308 (illustrated in FIG. 3 as 308*m*, 308*n*, 308*o*, and 308*p*).

When the fabric 102 is mounted on the rail 106 along the fabric seam 208, the fabric 102 folds and hangs freely over the rail 106 (as illustrated in FIG. 1). In this position, the first locking mechanism 218 may couple to the second locking mechanism 222. Coupling the first locking mechanism 218 to the second locking mechanism 222 may secure the fabric 102 to the rail 106. To keep the fabric 102 secured to the rail 106, the first set of snap buttons 308 may couple to the third set of snap buttons 308. For example, when the fabric 102 is mounted to the rail 106 and folded (as illustrated in FIG. 1), button 308*a* couples to button 308*l*, button 308*b* couples to button 308*k*, button 308*c* couples to button 308*j*, and button 308*d* couples to button 308*i*. The fabric 102 is further secured to the rail 106 when the second set of snap buttons 308 is coupled to the fourth set of snap buttons 308. For example, when the fabric 102 is mounted to the rail 106 and folded (as illustrated in FIG. 1), button 308*e* couples to button 308*p*, button 308*f* couples to button 308*o*, button 308*g* couples to button 308*n*, and button 308*h* couples to button 308*m*.

Figure 4:
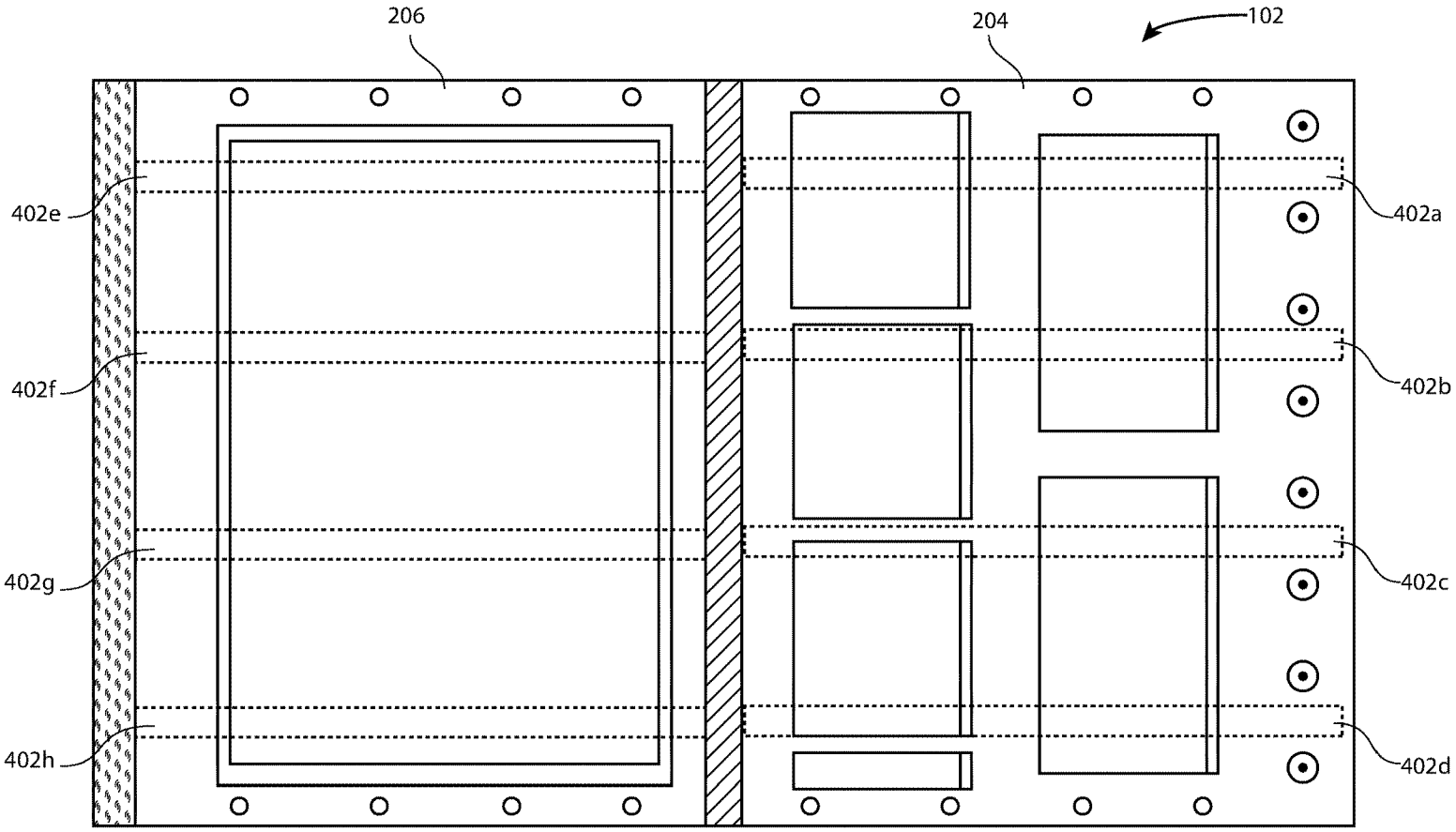
FIG. 4 is a plan view of a front side of a mountable fabric having a plurality of rigid strips, a plurality of pockets, and a detachable transparent pocket.
Figure 5:
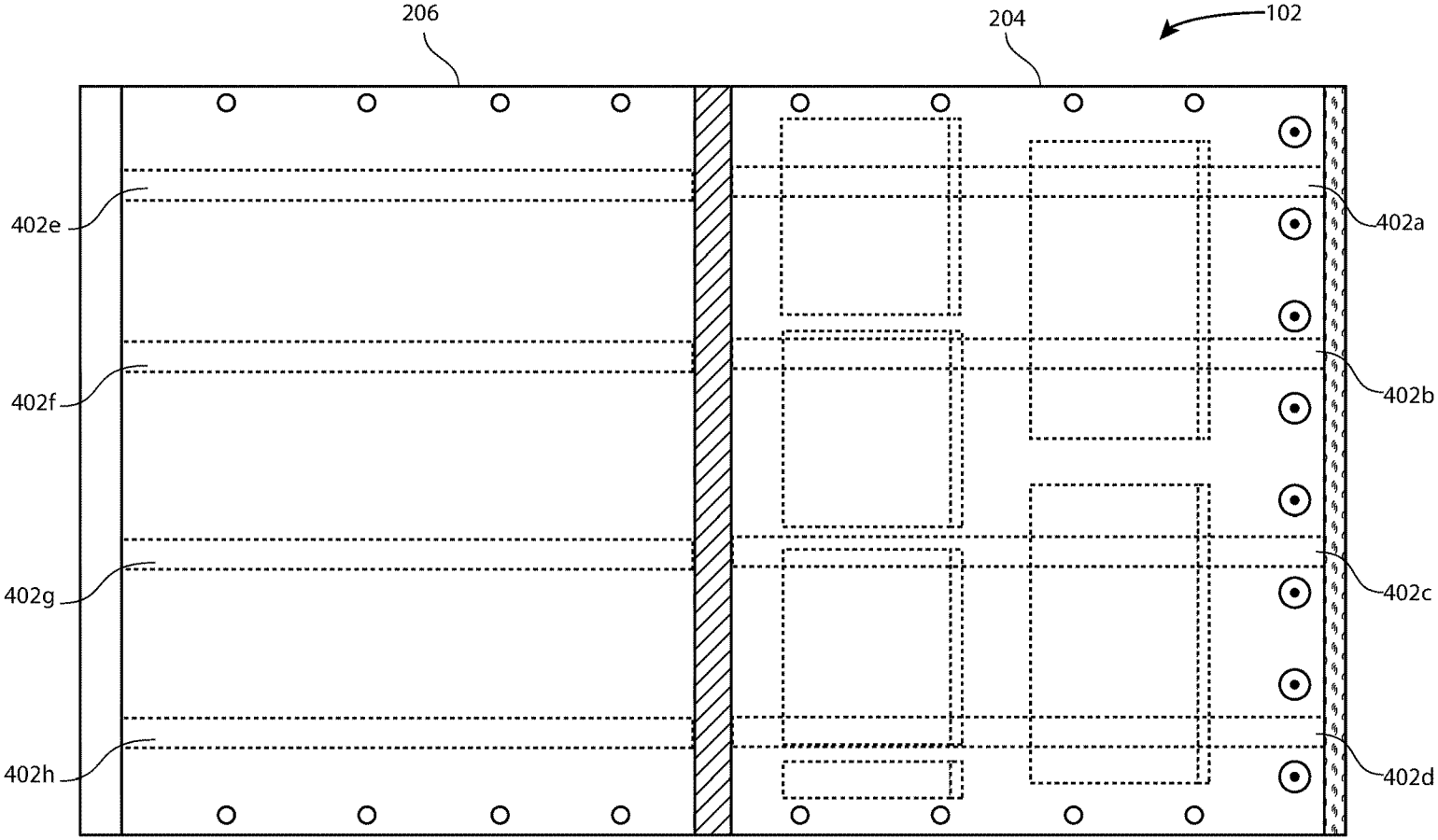
FIG. 5 is a plan view of a rear side of a mountable fabric having a plurality of rigid strips, a plurality of pockets, and a detachable transparent pocket.

FIG. 4 is a plan view of a front side of a mountable fabric having a plurality of rigid strips, a plurality of pockets, and a detachable transparent pocket. FIG. 5 is a plan view of a rear side of a mountable fabric having a plurality of rigid strips, a plurality of pockets, and a detachable transparent pocket. In one or more embodiments, the first fabric section 204 includes a plurality of rigid strips 402 (illustrated by the dashed lines 402*a*, 402*b*, 402*c*, and 402*d*). In one or more embodiments, the second fabric section 206 may include a plurality of rigid strips 402 (illustrated by dashed lines 402*e*, 402*f*, 402*g*, and 402*h*). The rigid strips 402 may be sewn into the material of the fabric 102 using nylon thread. The rigid strips 402 may be detachable from the fabric 102. For example, the rigid strips 402 may be coupled to the fabric 102 using Velcro® provided by Velcro Industries B.V., or any similar material. Adding the rigid strips 402 to the fabric 102 adds additional support to fabric 102 for holding tools 108. For example, the rigid strips 402 braces the fabric 102 such that the tools 108 won't fall out due to the weight of the tool 108. In addition, the rigid strips 402 also keeps the fabric 102 from falling off the rail 106.

Figure 6:
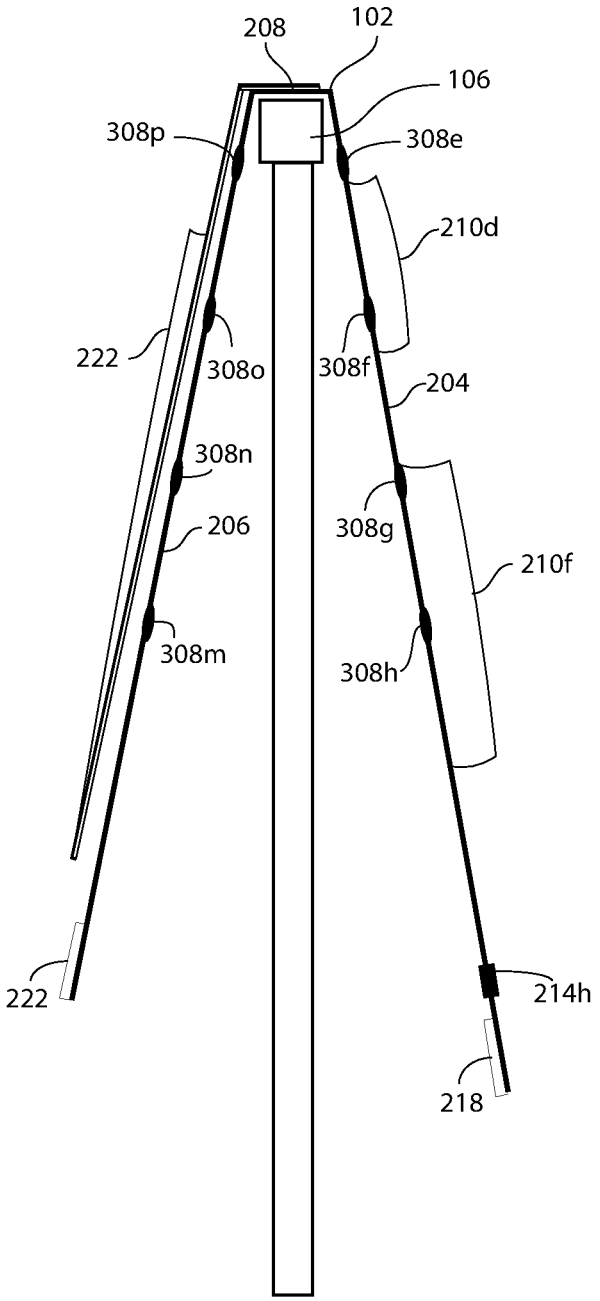
FIG. 6 is a profile view of a mountable fabric having a plurality of pockets and a detachable transparent pocket mounted on a rail.

FIG. 6 is a profile view of a mountable fabric having a plurality of pockets and a detachable transparent pocket mounted on a rail. As discussed above in connection with FIGS. 1-5, the fabric 102 is mounted on the rail 106. In one or more embodiments, the fabric seam 208 is positioned along the rail 106 such that the first fabric section 204 and the second fabric section 206 are able to hang freely. The length and the width of the first fabric section 204 and the second fabric section 206 may be adjusted to compensate for weight distribution. For example, the first fabric section 204 may have a length of 27 inches (68.58 cm.) and the second fabric section may have a length of 24 inches (60.96 cm.). The width of the fabric 102 (i.e., the width of the fabric seam 208) may have a measurement of 30.75 inches (78.11 cm.)

Figure 7:
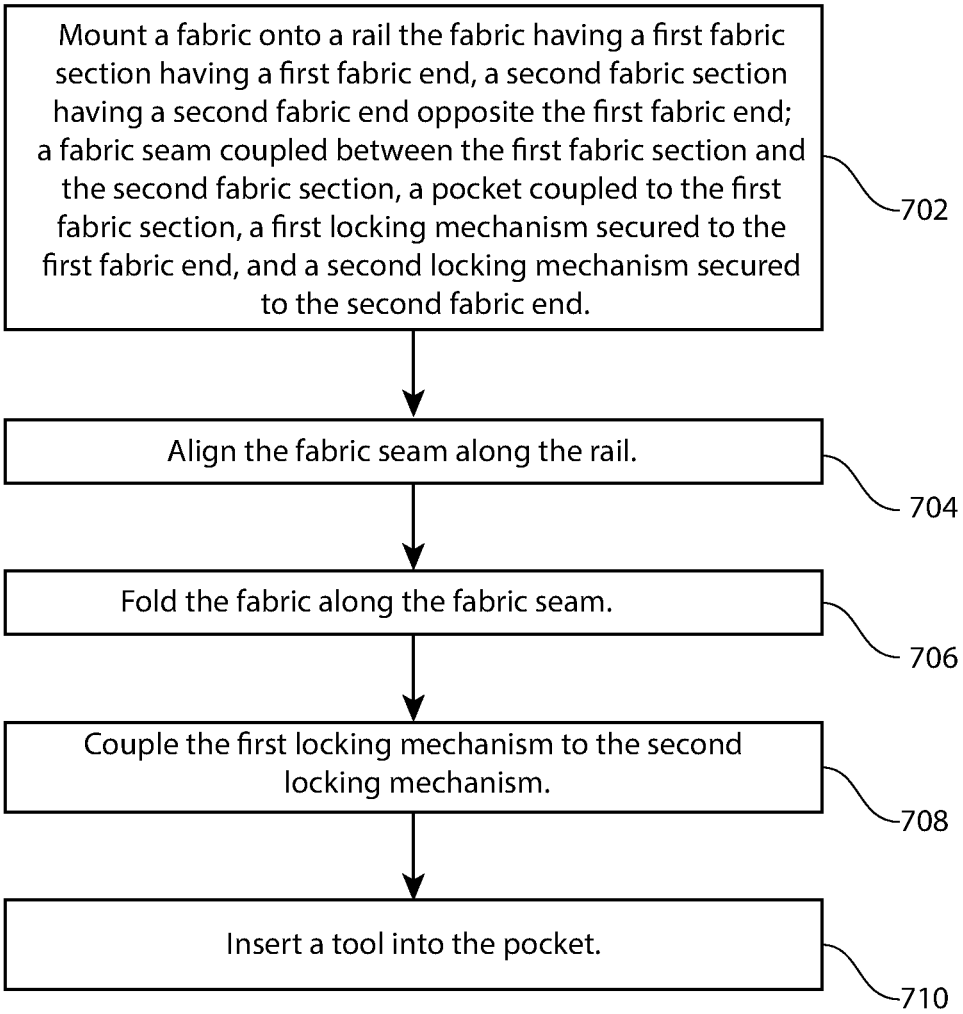
FIG. 7 is a flow chart of the method of mounting a fabric onto a rail.

FIG. 7 is a flow chart of the method of mounting a fabric onto a rail. The process includes mounting a fabric (such as fabric 102) onto a rail (such as rail 106), the fabric (such as fabric 102) having a first fabric section (such as first fabric section 204) having a first fabric end (such as first fabric end 212), a second fabric section (such as second fabric section 206) having a second fabric end (such as second fabric end 220) opposite the first fabric end (such as first fabric end 212), a fabric seam (such as fabric seam 208) coupled between the first fabric section (such as first fabric section 204) and the second fabric section (such as second fabric section 206), a pocket (such as pocket 210) coupled to the first fabric section (such as first fabric section 204), a first locking mechanism (such as first locking mechanism 218) secured to the first fabric end (such as first fabric end 212), and the second locking mechanism (such as second locking mechanism 222) secured to the second fabric end (such as second fabric end 220) (block 702). Aligning the fabric seam (such as fabric seam 208) along the rail (such as rail 106) (block 704). Folding the fabric (such as fabric 102) along the fabric seam (such as fabric seam 208) (block 706). Coupling the first locking mechanism (such as first locking mechanism 218) to the second locking mechanism (such as second locking mechanism 222) (block 708). Inserting a tool (such as tool 108) into the pocket (such as pocket 210).

In one aspect, the apparatus includes a mountable fabric having a first fabric section having a first fabric end. The mountable fabric has a second fabric section having a second fabric end opposite the first fabric end. A fabric seam is coupled between the first fabric section and the second fabric section. At least one pocket is coupled to the first fabric section. A first locking mechanism is secured to the first fabric end. A second locking mechanism is secured to the second fabric end. When the mountable fabric is folded along the fabric seam the first locking mechanism is couplable to the second locking mechanism.

Implementation may include one or more of the following. At least one rigid strip may be coupled to the first fabric section. At least one rigid strip may be coupled to the second fabric section end. The second fabric section may include a detachable transparent pocket. The fabric may be rigid. The first fabric section may include a first fabric section having an array of first fabric side snap buttons. The first fabric section may include a second fabric side having an array of second fabric side snap buttons. The second fabric section may include a third fabric side having an array of third fabric side snap buttons. The second fabric section may include a fourth side having an array of fourth fabric side snap buttons. The fabric may be folded along the first fabric seam. The first fabric side snap buttons may couple to the corresponding third fabric side snap buttons.

In one aspect, a method includes mounting a fabric onto a rail. The fabric having a first fabric section having a first fabric end. The fabric has a second fabric section having a second fabric end opposite the first fabric end. The fabric has a fabric seam coupled between the first fabric section and the second fabric section. The fabric has at least one pocket coupled to the first fabric section. The fabric has a first locking mechanism secured to the first fabric end. The fabric has a second locking mechanism secured to the second fabric end. The fabric seam is aligned along the rail. The fabric is folded along the fabric seam. The first locking mechanism is coupled to the second locking mechanism. A tool may be inserted into the pocket.

Implementation may include one or more of the following. At least one rigid strip may be coupled to the first fabric section. At least one rigid strip may be coupled to the second fabric section end. The second fabric section may include a detachable transparent pocket. The fabric may be rigid. The first fabric section may include a first fabric section having an array of first fabric side snap buttons. The first fabric section may include a second fabric side having an array of second fabric side snap buttons. The second fabric section may include a third fabric side having an array of third fabric side snap buttons. The second fabric section may include a fourth side having an array of fourth fabric side snap buttons. The fabric may be folded along the first fabric seam. The first fabric side snap buttons may couple to the corresponding third fabric side snap buttons.

In one aspect, the system may include an aerial platform having a rail. A mountable fabric is coupled to the rail. The mountable fabric has a first fabric section having a first fabric end. The mountable fabric has a second fabric section having a second fabric end opposite the first fabric end. The mountable fabric has a fabric seam coupled between the first fabric section and the second fabric section. The mountable fabric has at least one pocket coupled to the first fabric section. The mountable fabric has a first locking mechanism secured to the first fabric end. The mountable fabric has a second locking mechanism secured the second fabric end. The mountable fabric is folded along the fabric seam and the first locking mechanism is coupled to the second locking mechanism.

Implementation may include one or more of the following. At least one rigid strip may be coupled to the first fabric section. At least one rigid strip may be coupled to the second fabric section end. The second fabric section may include a detachable transparent pocket. The fabric may be rigid. The first fabric section may include a first fabric section having an array of first fabric side snap buttons. The first fabric section may include a second fabric side having an array of second fabric side snap buttons. The second fabric section may include a third fabric side having an array of third fabric side snap buttons. The second fabric section may include a fourth side having an array of fourth fabric side snap buttons. The fabric may be folded along the first fabric seam. The first fabric side snap buttons may couple to the corresponding third fabric side snap buttons.

The operations of the flow diagrams are described with references to the systems/apparatus shown in the block diagrams. However, it should be understood that the operations of the flow diagrams could be performed by embodiments of systems and apparatus other than those discussed with reference to the block diagrams, and embodiments discussed with reference to the systems/apparatus could perform operations different than those discussed with reference to the flow diagrams.

The word "coupled" herein means a direct connection or an indirect connection.

The text above describes one or more specific embodiments of a broader invention. The invention also is carried out in a variety of alternate embodiments and thus is not limited to those described here. The foregoing description of an embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An apparatus for holding a tool comprising:

a mountable fabric having:

a first fabric section having a first fabric end;

a second fabric section having a second fabric end opposite the first fabric end;

a fabric seam coupled between the first fabric section and the second fabric section;

a plurality of rigid strips coupled to the first fabric section; and a plurality of rigid strips coupled to the second fabric section;

at least one pocket coupled to the first fabric section;

a first locking mechanism secured to the first fabric end; and a second locking mechanism secured to the second fabric end;

wherein when the mountable fabric is folded along the fabric seam the first locking mechanism is couplable to the second locking mechanism.

2. The apparatus of claim 1 further comprising the fabric seam comprising a rigid strip coupled between the first fabric section and to the second fabric section.

3. The apparatus of claim 1 wherein second fabric section includes a detachable transparent pocket.

4. The apparatus of claim 1 wherein the fabric seam is rigid.

5. The apparatus of claim 1 wherein the first fabric section includes:

a first fabric side having an array of first fabric side snap buttons;

a second fabric side having an array of second fabric side snap buttons; and wherein the second fabric section includes:

a third fabric side having an array of third fabric side snap buttons; and a fourth fabric side having an array of fourth fabric side snap buttons.

6. The apparatus of claim 5 wherein when the mountable fabric is folded along the fabric seam, the first fabric side snap buttons couples to the corresponding third fabric side snap buttons.

7. The apparatus of claim 5 wherein when the mountable fabric is folded along the fabric seam, the second fabric side snap buttons couples to the corresponding fourth fabric side snap buttons.

* * * * *